US005356005A

United States Patent [19]

Burrello

[11] Patent Number: 5,356,005

[45] Date of Patent: Oct. 18, 1994

[54] SINGLE USE DENTAL MAINTENANCE DEVICE

[76] Inventor: David T. Burrello, Box 186, Sea Cliff, N.Y. 11579

[21] Appl. No.: 161,583

[22] Filed: Dec. 6, 1993

[51] Int. Cl.[5] ..... A61H 7/00; A46B 5/04

[52] U.S. Cl. ..... 206/362.4; 206/209.1; 15/227

[58] Field of Search ..... 15/227; 206/362.4, 209.1, 206/209, 362.2

[56] References Cited

U.S. PATENT DOCUMENTS

| | | | |
|---|---|---|---|
| 1,896,941 | 2/1933 | Cohen | 206/209 X |
| 2,419,896 | 4/1947 | Hobelmann | 206/362.4 X |
| 3,298,507 | 1/1967 | Micciche | 206/209.1 X |
| 3,368,668 | 2/1968 | Micciche | 206/209.1 X |
| 3,905,113 | 9/1975 | Jacob | 206/209.1 |
| 4,134,172 | 1/1979 | Arce | 206/362.4 X |
| 4,665,901 | 5/1987 | Spector | 206/209 X |
| 5,068,941 | 12/1991 | Dunn | 206/362.4 |
| 5,074,414 | 12/1991 | Romana | 206/362.4 |
| 5,228,433 | 7/1993 | Rosen | 15/227 X |

*Primary Examiner*—William I. Price

[57] ABSTRACT

A single use dental maintenance device embodies rows of nylon felt like strips adhered to a nonporous elastic tube and said strips coated with toothpowder. The opened end of the elastic tube is adhered to the inside of a paperboard cylinder in which elastic tube is folded and sealed with polyethylene film. By the user pushing his or her index finger thru the designated opening unfolds the tube over the index finger and allows the user to clean and polish teeth in a manner similar to brushing.

5 Claims, 2 Drawing Sheets

SINGLE USE DENTAL MAINTENANCE DEVICE

BACKGROUND OF THE INVENTION

1. Field of the Invention

The present invention relates to a device to maintain dental health. More specifically the present invention pertains to a device to maintain dental health in a efficient and convenient manner when not having at one's disposal a toothbrush and toothpaste.

2. Prior Art

Maintaining dental health has always been a standard practice in daily hygiene, accomplish ed by the act of "brushing" one's teeth with a brush attached to a handle whereas the brush is covered with toothpaste to facilitate cleaning and polishing. Accordingly people who's lives take them away from their residence daily, encounter this ongoing problem and in general have one way to maintain their teeth, that is by the use of a toothbrush and toothpaste, unfortunately the act of carrying a toothbrush with toothpaste thru the day has been an inconvenience and a practice rarely done,as so noticed by the inventor. One way of solving the problem has been the use of a collapsible handle with a removable head toothbrush, but the inherent inconvenience still remains, where does one place toothpaste and brush and more importantly the remembering of taking it daily.

No device is known that will allow an available and quick way to brush and polish teeth when in public restrooms.

SUMMARY OF THE INVENTION

The principle object of the invention is to provide a device that will allow people in public, whether at work or play, to have available a means to maintain their dental health without the inconvenience of carrying toothpaste and brush.

It is also an object of the present invention to provide a device with a simple and inexpensive means of construction.

Another object is to provide the device in a sterile sealed container that will aid in storing and using said device.

A further object is to allow the container to display pertinent information.

Also an object of the invention is to provide such a device made available in restrooms so as that to increase dental awareness and promote dental hygiene for the public.

Another object of the invention is to provide to penal institutions a method of dental maintenance to thwart the possibility of turning a toothbrush handle into a deadly instrument.

The foregoing objects can be accomplished by providing a device having a paperboard cylindrical container in which an elastic tube that has a series of strips at the tip which in turn have a nylon felt like material where toothpowder has been applied. In the preferred embodiment of the invention the elastic tube is much like that of a digit from a surgical glove whereas the strips are composed of the loop part of a hook and loop fastener that will allow toothpowder to be contained prior to use located at the tip of the elastic digit. The cylindrical paperboard container will have a tab on one side to aid in installing, and the opened ends be covered with a thin polyethylene film thereby keeping the elastic tube sealed in its sterile environment. By the user holding the tab and placing a finger on the designated opening and pushing it thru will unfold the elastic tube over his or her finger and allow the user to clean and polish their teeth in a manner similar to brushing.

DETAIL DESCRIPTION OF DRAWINGS

Figure 4:
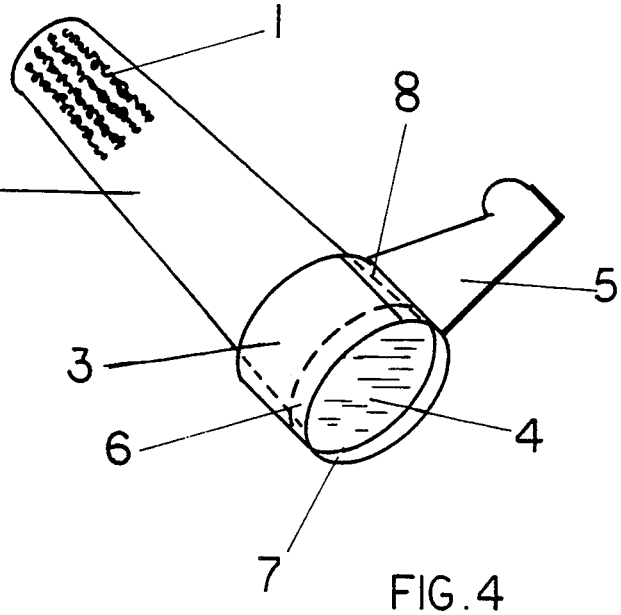
FIG. 4 is isometric view of the present invention in its useable state
Figure 2:
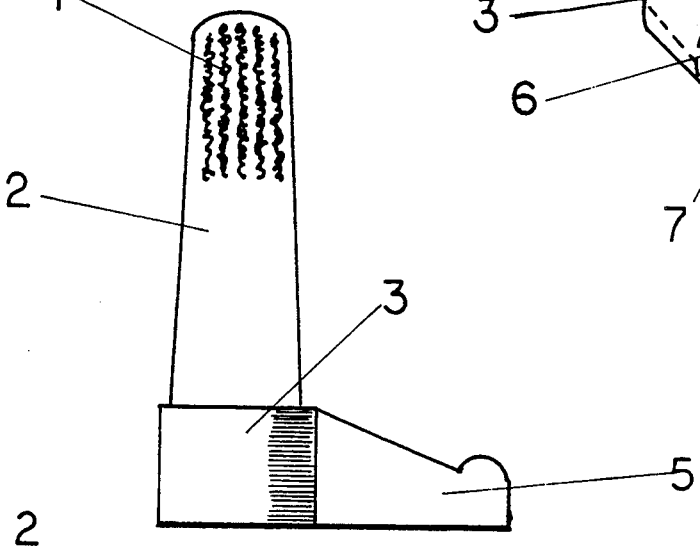
FIG. 2 is a side elevation of the present invention in its useable state.
Figure 3:
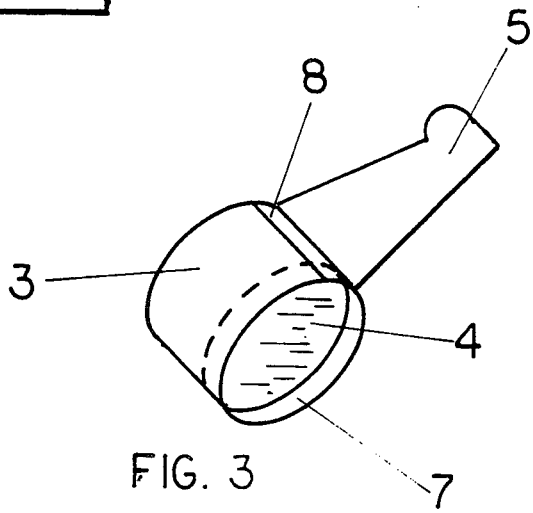
FIG. 3 is a isometric view of the present invention in its storage state
Figure 1:
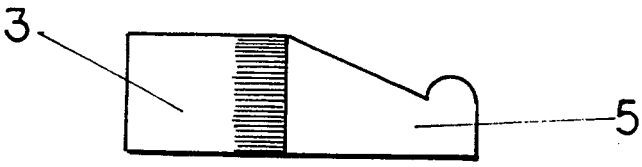
FIG. 1 is side elevation of the single use dental maintenance device in its contained state in accordance with the present invention.
Figure 5:
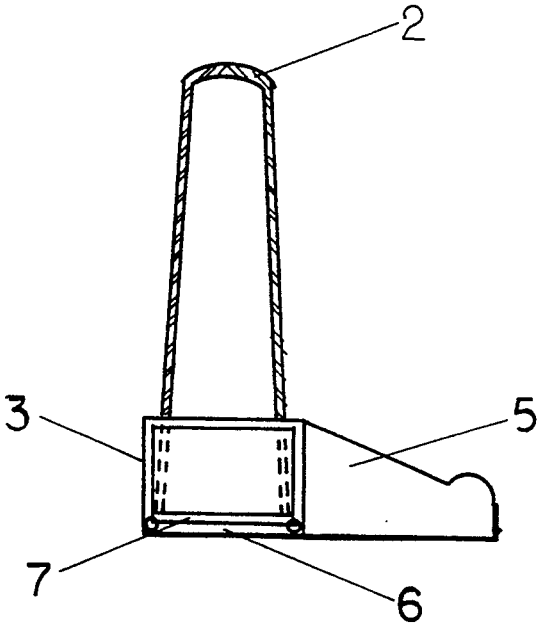
FIG. 5 is a section view of the present invention.
Figure 6:
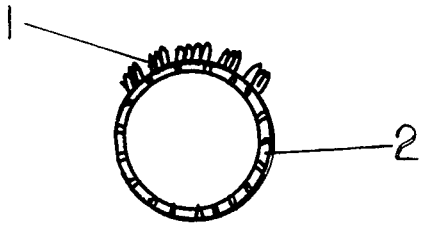
FIG. 6 is a sectional view of the tip of the invention
Figure 7:
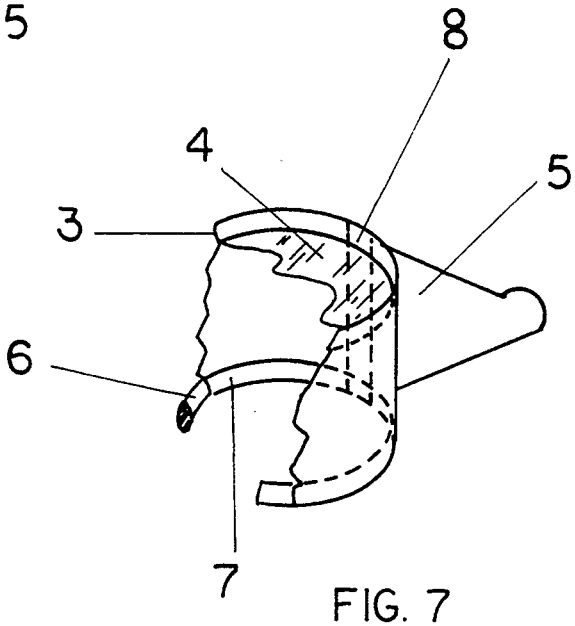
FIG. 7 is a cutaway of the container of the invention.
Figure 8:
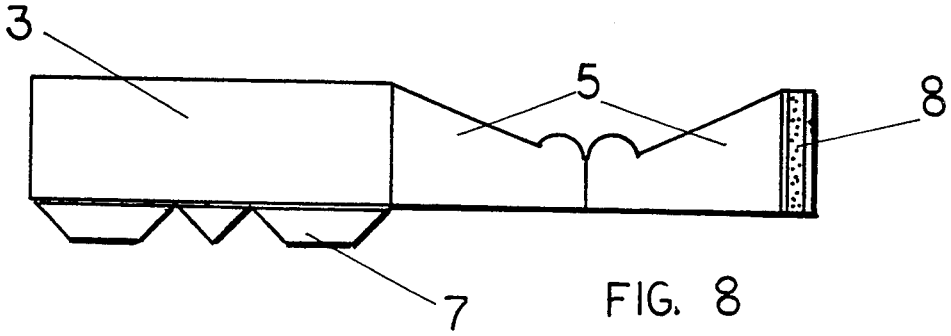
FIG. 8 is a blank of the unfolded cardboard container.

As shown on sheet one, FIG. 2 in the drawings the preferred single use dental maintenance device in accordance with the present invention is comprised of and not limited to 1 five rows of nylon felt like looped strips, coated with toothpowder, each strip being ¾ of an inch in length by 1/16 of an inch wide with a nap height of 1/16 of an inch in which the strips are adhered to the closed 2 end of a nonporous elastic tube, not unlike that of a digit from a surgical glove, with a length of 3 and ½ inches and a tip that is 5/8 of an inch in diameter and an opening 1 inch in diameter which in turn the rim of the open end of the nonporous tube is adhered to by glue to 3 a paperboard container with a diameter of 1 and ½ inch and length of ¾ of an inch whereas,in FIG. 3 the container 3 is to be capped at opened ends with a thin polyethylene film 4 which is glued to the glue flaps on rims of the container, whereas the container is to have a tab 5 to allow the installation and subsequent removal of the device. Referring to sheet 2, FIG. 5 shows a length wise section thru the invention and FIG. 6 shows an enlarged section at the tip showing the 1 nylon felt like strips and FIG. 7 is an enlarged cutaway showing the 6 rim of elastic tube adhered to glue flap 7. FIG. 8 is a blank of the paperboard container showing 7 glue flap for elastic tube and 8 glue flap on 5 tab, The foregoing description of the preferred embodiment of the invention has been presented for the purpose of illustration and description. It is not intended to be exhaustive or to limit the invention to the precise form disclosed. Many modifications and variations are possible in light of the present teaching. It is intended that the scope of this invention be limited not by this detailed description, but rather by the claims appended hereto.

I claim:

1. A single use dental maintenance device comprising a non-porous elastic tube of a size to fit over the index finger, said tube being closed at one end and open at the other end, rows of bristles attached to said tube proximate said closed end at the area where the ball of the finger is located, means adhering said open end of said tube to the inside surface of a paperboard cylinder, means for sealing the cylinder at each end for packaging the adhered tube therein.

2. The device of claim 1 wherein said cylinder includes a pair of tabs extending from the side thereof.

3. The device of claim 1 wherein the means for sealing said cylinder comprises a polyethylene film.

4. The device of claim 1 wherein the means for adhering said tube includes a folded glue flap.

5. The device of claim 1 wherein said rows of bristles comprise parallel strips of the loop part of a hook and loop fastening device.

* * * * *